US007040965B2

(12) United States Patent
Taylor et al.

(10) Patent No.: US 7,040,965 B2
(45) Date of Patent: May 9, 2006

(54) METHODS FOR REMOVING DOPED SILICON MATERIAL FROM MICROFEATURE WORKPIECES

(75) Inventors: Theodore M. Taylor, Boise, ID (US); Stephen J. Kramer, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/665,964

(22) Filed: Sep. 18, 2003

(65) Prior Publication Data

US 2005/0064797 A1 Mar. 24, 2005

(51) Int. Cl.
*B24B 1/00* (2006.01)

(52) U.S. Cl. ..... 451/41; 451/36; 451/60; 451/63; 451/288; 451/289; 451/446; 51/308; 51/309

(58) Field of Classification Search ..... 451/36, 451/41, 60, 63, 288, 289, 446; 51/308, 309
See application file for complete search history.

(56) References Cited

U.S. PATENT DOCUMENTS

| | | | |
|---|---|---|---|
| 5,209,816 | A | 5/1993 | Yu et al. |
| 5,225,034 | A | 7/1993 | Yu et al. |
| 5,232,875 | A | 8/1993 | Tuttle et al. |
| 5,354,490 | A | 10/1994 | Yu et al. |
| 5,486,129 | A | 1/1996 | Sandhu et al. |
| 5,540,810 | A | 7/1996 | Sandhu et al. |
| 5,609,718 | A | 3/1997 | Meikle |
| 5,618,447 | A | 4/1997 | Sandhu |
| 5,658,183 | A | 8/1997 | Sandhu et al. |
| 5,700,180 | A | 12/1997 | Sandhu et al. |
| 5,730,642 | A | 3/1998 | Sandhu et al. |
| 5,827,781 | A | 10/1998 | Skrovan et al. |
| 5,842,909 | A | 12/1998 | Sandhu et al. |
| 5,851,135 | A | 12/1998 | Sandhu et al. |
| 5,895,550 | A | 4/1999 | Andreas |
| 5,916,819 | A | 6/1999 | Skrovan et al. |
| 5,990,012 | A | 11/1999 | Robinson et al. |
| 5,994,224 | A | 11/1999 | Sandhu et al. |
| 5,997,384 | A | 12/1999 | Blalock |
| 6,040,245 | A | 3/2000 | Sandhu et al. |
| 6,060,395 | A | 5/2000 | Skrovan et al. |

(Continued)

OTHER PUBLICATIONS

Kondo, S. et al., "Abrasive-Free Polishing for Copper Damascene Interconnection," Journal of The Electrochemical Society, vol. 147, No. 10, pp. 3907-3913, The Electrochemical Society, Inc., Pennington, New Jersey, 2000.

(Continued)

*Primary Examiner*—Lee D. Wilson
*Assistant Examiner*—Shantese McDonald
(74) *Attorney, Agent, or Firm*—Perkins Coie LLP

(57) ABSTRACT

Methods for removing material from microfeature workpieces are disclosed. A method in accordance with one embodiment of the invention includes disposing a surfactant-bearing polishing liquid between a doped silicon material of the microfeature workpiece and a polishing pad material. At least one of the workpiece and the polishing pad material is moved relative to the other to simultaneously and uniformly remove at least some of the doped silicon material from portions of the workpiece having different crystalinities and/or different doping characteristics. The surfactant can include a generally non-ionic surfactant having a relatively low concentration in the polishing liquid, for example, from about 0.001% to about 1.0% by weight.

48 Claims, 3 Drawing Sheets

U.S. PATENT DOCUMENTS 6,074,286 A 6/2000 Ball
6,077,785 A 6/2000 Andreas
6,116,988 A 9/2000 Ball
6,124,207 A 9/2000 Robinson et al.
6,136,218 A 10/2000 Skrovan et al.
6,176,763 B1 1/2001 Kramer et al.
6,187,681 B1 2/2001 Moore
6,203,404 B1 3/2001 Joslyn et al.
6,203,407 B1 3/2001 Robinson
6,206,757 B1 3/2001 Custer et al.
6,224,466 B1 5/2001 Walker et al.
6,234,874 B1 5/2001 Ball
6,234,877 B1 5/2001 Koos et al.
6,250,994 B1 6/2001 Chopra et al.
6,267,650 B1 7/2001 Hembree
6,271,139 B1 8/2001 Alwan et al.
6,273,786 B1 8/2001 Chopra et al.
6,276,996 B1 8/2001 Chopra
6,284,660 B1 9/2001 Doan
6,306,012 B1 10/2001 Sabde
6,306,768 B1 10/2001 Klein
6,312,486 B1 11/2001 Sandhu et al.
6,312,558 B1 11/2001 Moore
6,313,038 B1 11/2001 Chopra et al.
6,338,667 B1 1/2002 Sandhu et al.
6,350,180 B1 2/2002 Southwick
6,354,917 B1 3/2002 Ball
6,354,930 B1 3/2002 Moore
6,368,194 B1 4/2002 Sharples et al.
6,375,548 B1 4/2002 Andreas
6,376,381 B1 4/2002 Sabde
6,635,556 B1 * 10/2003 Herner et al. ..... 438/488
6,726,534 B1 * 4/2004 Bogush et al. ..... 451/36
6,776,691 B1 * 8/2004 Nishimura et al. ..... 451/36
6,811,470 B1 * 11/2004 Bonner et al. ..... 451/41

OTHER PUBLICATIONS

Lee, J. et al., "Effects of Nonionic Surfactants on Oxide-to-Polysilicon Selectivity during Chemical Mechanical Polishing," Journal of the Electrochemical Society, vol. 149, No. 8, pp. G477-G481, The Electrochemical Society, Inc., Pennington, New Jersey, 2002.

"Safety (MSDS) data for brij 58", 2 pages, <http://psychem.ox.ac.uk/MSDS/BR/brij_58.html>.

Sigma-Aldrich, Inc., Sigma Product Information Sheet—Brij Detergents, 2 pages, <http://www.sigmaaldrich.com/sigma/proddata/p4391x.htm>.

* cited by examiner

METHODS FOR REMOVING DOPED SILICON MATERIAL FROM MICROFEATURE WORKPIECES

TECHNICAL FIELD

The present invention relates to methods and apparatuses for removing doped silicon material from microfeature workpieces.

BACKGROUND

Mechanical and chemical-mechanical planarization processes (collectively, "CMP") remove material from the surfaces of micro-device workpieces in the production of microelectronic devices and other products. FIG. 1 schematically illustrates a rotary CMP machine 10 with a platen 20, a carrier head 30, and a polishing pad 40. The CMP machine 10 may also have an under-pad 25 between an upper surface 22 of the platen 20 and a lower surface of the polishing pad 40. A drive assembly 26 rotates the platen 20 (as indicated by arrow F) and/or reciprocates the platen 20 back and forth (as indicated by arrow G). Because the polishing pad 40 is attached to the under-pad 25, the polishing pad 40 moves with the platen 20 during planarization.

The carrier head 30 has a lower surface 32 to which a microfeature workpiece 50 may be attached, or the workpiece 50 may be attached to a resilient pad 34 under the lower surface 32. The carrier head 30 may be a weighted, free-floating wafer carrier, or an actuator assembly 36 may be attached to the carrier head 30 to impart rotational motion (as indicated by arrow J) and/or reciprocal motion (as indicated by arrow 1) to the microfeature workpiece 50.

The polishing pad 40 and a polishing solution 60 define a polishing or planarizing medium that mechanically and/or chemically-mechanically removes material from the surface of the microfeature workpiece 50. The polishing solution 60 may be a conventional CMP slurry with abrasive particles and chemicals that etch and/or oxidize the surface of the microfeature workpiece 50, or the polishing solution 60 may be a "clean" nonabrasive solution without abrasive particles. In most CMP applications, abrasive slurries with abrasive particles are used on non-abrasive polishing pads, and clean non-abrasive solutions without abrasive particles are used on fixed-abrasive polishing pads.

To planarize the microfeature workpiece 50 with the CMP machine 10, the carrier head 30 presses the workpiece 50 facedown against the polishing pad 40. More specifically, the carrier head 30 generally presses the microfeature workpiece 50 against the polishing solution 60 on a polishing surface 42 of the polishing pad 40, and the platen 20 and/or the carrier head 30 moves to rub the workpiece 50 against the polishing surface 42. As the microfeature workpiece 50 rubs against the polishing surface 42, the polishing medium removes material from the face of the workpiece 50.

During many of the CMP processes conducted to form a typical microfeature workpiece, it is necessary to stop the material removal process at a selected plane of the microfeature workpiece 50. Accordingly, existing processes include disposing a stop layer at the selected plane in the microfeature workpiece 50. The chemical makeup of the polishing solution 60 is then chosen to (a) preferentially remove material overlaying the stop layer, and (b) stop removing material from the workpiece 50 when the stop layer is exposed. For example, polysilicon has been proposed as a stop layer material when positioned adjacent to an oxide layer, and one proposed polishing solution 60 includes a non-ionic surfactant that selectively removes the oxide and then stops the material removal upon exposing the underlying polysilicon stop layer. Further details of methods and solutions for carrying out such a process are disclosed in an article titled "Effects Of Non-Ionic Surfactants On Oxide-To-Polysilicon Selectively During Chemical Mechanical Polishing," (Lee et al., *J. of the Electrochemical Society*, Jun. 17, 2002) incorporated herein in its entirety by reference.

Polysilicon has other functions in a typical microfeature workpiece 50. For example, many conventional microfeature workpieces 50 include doped polysilicon as a component for forming conductive and/or semiconductive microelectronic structures. One problem associated with conventional methods for planarizing doped polysilicon is that such methods tend to leave defects in the planarized polysilicon surface. These defects can include holes, pits, divots, or other non-uniformities that adversely affect the performance of the conductive via or other structure formed from the polysilicon. One approach to addressing this problem is to reduce the level of doping in the polysilicon. A drawback with this approach is that it can adversely affect the conductivity of the polysilicon, and therefore the performance of devices formed from the polysilicon. Another approach to addressing this drawback is to adjust some process conditions at which the polysilicon is deposited on the microfeature workpiece 50. A drawback with this approach is that it can increase the time required to complete the deposition process and can accordingly increase the cost of producing devices from the microfeature workpiece 50.

DETAILED DESCRIPTION

A. Introduction

Figure 1:
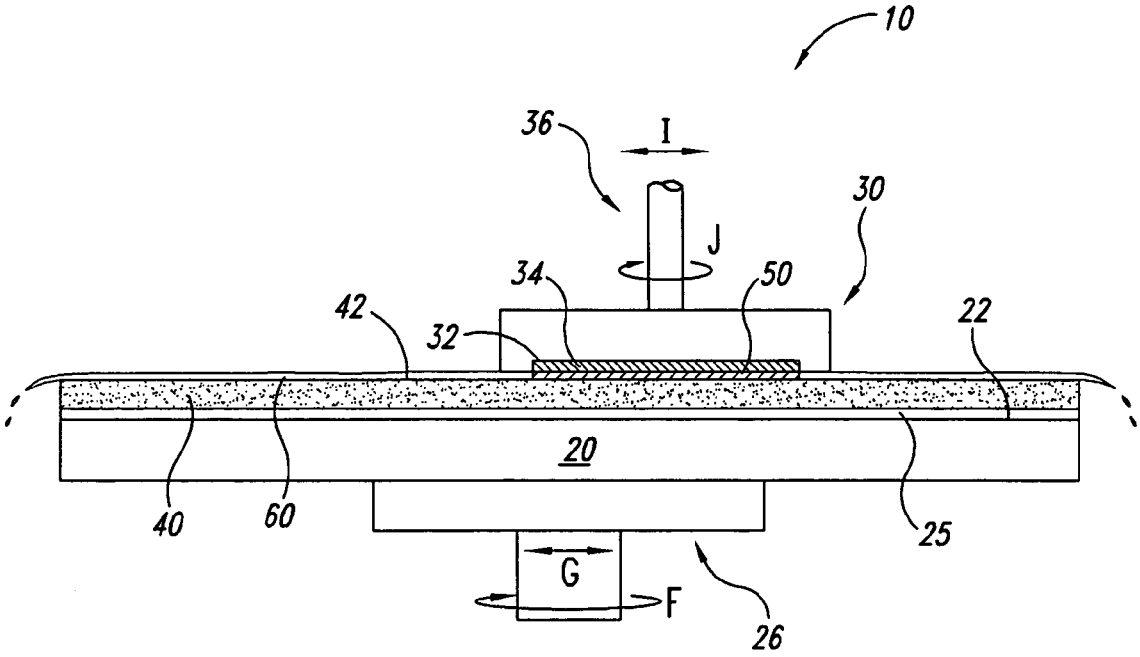
Fig. 1 (Prior Art)
FIG. 1 is a partially schematic, cross-sectional side view of a portion of a rotary planarizing machine in accordance with the prior art.

The present invention is directed toward methods and apparatuses for removing doped polysilicon from microfeature workpieces. The term "microfeature workpiece" is used throughout to include a workpiece formed from a substrate upon which and/or in which submicron circuits or components, and/or data storage elements or layers are fabricated. Submicron features in the substrate include but are not limited to trenches, vias, lines, and holes. These features typically have a submicron width (e.g., ranging from, for example, 0.1 micron to 0.75 micron) generally transverse to a major surface (e.g., a front side or a back side) of the workpiece. The term "microfeature workpiece" is also used to include a substrate upon which and/or in which micromechanical features are formed. Such features include read/write head features and other micromechanical features having submicron or supramicron dimensions. In any of these embodiments, the workpiece substrate is formed from suitable materials, including ceramics, and may support layers and/or other formations of other materials, including but not limited to metals, dielectric materials and photoresists.

A method for removing material from a microfeature workpiece in accordance with one aspect of the invention includes contacting a polishing pad material with a portion of a microfeature workpiece having a doped silicon material. The method can further include disposing a polishing liquid between the doped silicon material and the polishing pad material, with the polishing liquid including a surfactant. At least one of the microfeature workpiece and the polishing pad material is moved relative to the other while the microfeature workpiece contacts the polishing pad material and the polishing liquid. The method can further include simultaneously and uniformly removing at least some of the doped silicon material from regions of the microfeature workpiece having different crystalinities and/or different doping characteristics by contacting the doped silicon material with a surfactant in the polishing liquid as at least one of the microfeature workpiece and the polishing material moves relative to the other.

In further aspects of the invention, the surfactant can be selected to include a generally non-ionic surfactant, and/or the polishing liquid can include from about 0.001% to about 1.0% surfactant by weight. In still further aspects of the invention, the method can include disposing a first polishing liquid between the doped silicon material and the polishing pad material for removing at least some of the doped silicon material at a first rate, and disposing a second polishing liquid (having a surfactant) between the doped silicon material and the polishing pad material to remove at least some of the doped silicon material at a second rate slower than the first rate. The second polishing liquid can be formed by disposing a surfactant in the first polishing liquid, or it can be separately disposed on the polishing pad material. In still a further aspect of the invention, the microfeature workpiece can be moved from one polishing pad material (having the first polishing liquid) to another polishing pad material (having the second polishing liquid) during processing.

B. Methods and Apparatuses for Removing Doped Polysilicon

Figure 2:
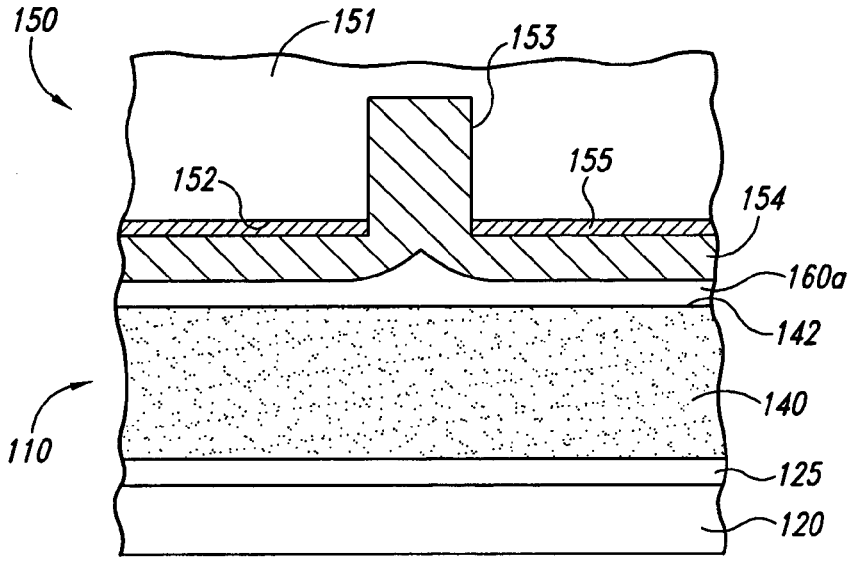
FIG. 2 is a partially schematic cross-sectional side elevational view of a portion of a polishing apparatus positioned to remove material from a microfeature workpiece in accordance with an embodiment of the invention.

FIG. 2 is a partially schematic illustration of a portion of an apparatus 110 configured to remove material from a microfeature workpiece 150 (a portion of which is shown in FIG. 2) in accordance with an embodiment of the invention. In one aspect of this embodiment, the apparatus 110 can include a platen 120 and an underpad 125 that support a polishing pad 140. The polishing pad 140 can have a polishing pad surface 142 that carries a first polishing liquid 160*a*. In one embodiment, the polishing pad 140 can be a fixed abrasive polishing pad having fixed abrasive elements disposed in the pad itself. The first polishing liquid 160*a* can accordingly include cutting fluid. In another embodiment, the first polishing liquid 160*a* can include a suspension of abrasive elements. In either embodiment, the polishing pad 140 and the first polishing liquid 160*a* can define a polishing medium for removing material from the microfeature workpiece 150, for example, during a planarizing process. The microfeature workpiece 150 can be supported by a carrier (not shown in FIG. 2) as it contacts the polishing medium. The carrier and/or the polishing pad 140 can move relative to each other in a manner generally similar to that described above to remove material from the microfeature workpiece 150.

In one aspect of an embodiment shown in FIG. 2, the microfeature workpiece 150 can include a substrate material 151 (e.g., an oxide glass) having a substrate material surface 152. The microfeature workpiece 150 can further include an aperture 153 extending from the substrate material surface 152. A doped silicon material 154 can be disposed in the aperture 153 and can extend over the substrate material surface 152 adjacent to the aperture 153. In one embodiment, the doped silicon material 154 can form a via to electrically connect features within or on the substrate material 151. In other embodiments, the doped silicon material 154 can form other structures. In a particular embodiment, the doped silicon material 154 can be negatively doped with substances such as phosphorous. In other embodiments, the doped polysilicon material 154 can be positively doped with substances such as boron.

In one embodiment, the doped silicon material 154 includes doped amorphous silicon, which is polished and heat treated to form doped polycrystalline silicon (or doped polysilicon). Accordingly, the term "doped silicon" includes both doped amorphous silicon and doped polysilicon. The processes described below as being performed on doped silicon materials and/or doped silicon portions can be performed on doped silicon and/or doped polysilicon.

In a further aspect of an embodiment shown in FIG. 2, the microfeature workpiece 150 can include an intermediate layer 155 between the substrate material surface 152 and the portion of the doped silicon material 154 disposed outwardly from the aperture 153. The intermediate layer 155 can include an anti-reflective coating, a stop layer, or another type of layer. In still further embodiments, the intermediate layer 155 can be eliminated.

During polishing, the excess doped silicon material 154 external to the aperture 153 can be removed as the microfeature workpiece 150 rubs against the polishing pad material 140 in the presence of the first polishing liquid 160*a*. In one embodiment, the material removal process can be conducted at a temperature of up to about 125° F., and in other embodiments, the process can be conducted at other temperatures. In one embodiment, the first polishing liquid 160*a* can include a commercially available slurry, for example, an alkaline, silica slurry available from Rodel of Newark, Del. In other embodiments, the first polishing liquid 160*a* can have other compositions.

Figure 3:
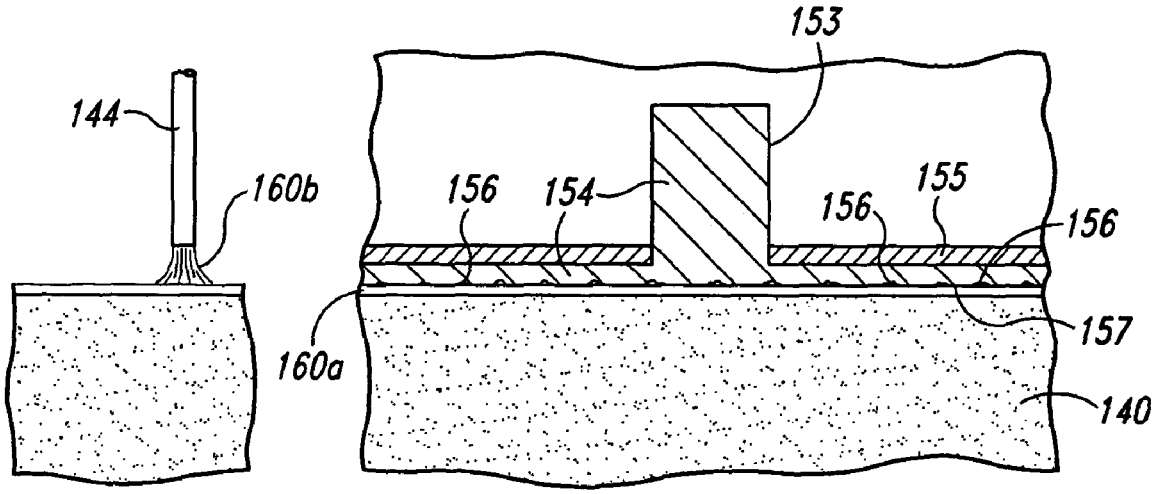
FIG. 3 is a partially schematic cross-sectional illustration of an arrangement for disposing a second polishing liquid adjacent to a microfeature workpiece in accordance with an embodiment of the invention.

Referring now to FIG. 3, the first polishing liquid 160*a* can form defects 156 in the doped silicon material 154. These defects 156 can include, but are not limited to, holes, pits, and/or divots. It is believed that the presence of such defects may be correlated with dopant-rich zones or regions of the doped silicon material 154, and/or regions of the doped silicon material 154 having increased levels of crystal order, and/or regions of the doped silicon material 154 having different crystal orientations. It is further believed that the foregoing conditions can lead to preferentially higher etch rates in some regions of the doped silicon material 154 than in others, which can in turn cause the formation of the defects 156. Accordingly, in one embodiment of the invention, a second polishing liquid 160*b* is disposed between the polishing pad 140 and the doped silicon material 154 as subsequent portions of the doped silicon material 154 are removed. This process can (a) eliminate the defects 156 present in the doped silicon material 154, and (b) prevent the formation of additional defects 156, as described in greater detail below.

Figure 5:
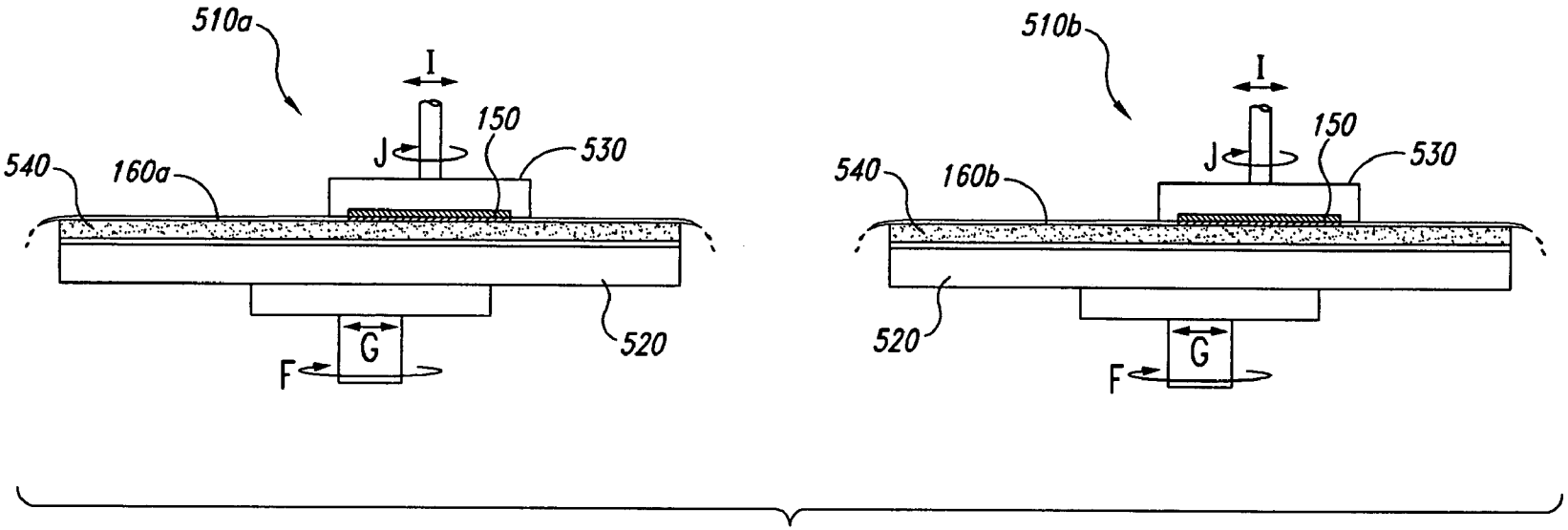
FIG. 5 is a partially schematic illustration of an arrangement of multiple planarizing apparatuses for removing doped silicon from microfeature workpieces.

In one embodiment, the second polishing liquid 160*b* is dispensed onto the polishing pad 140 via a dispense conduit 144. In one aspect of this embodiment, the second polishing liquid 160*b* dispensed via the dispense conduit 144 can include a surfactant and can completely displace the first polishing liquid 160*a*. In another aspect of this embodiment, the dispense conduit 144 can dispense a surfactant (and, optionally, other constituents) which mix with the existing first polishing liquid 160*a* on the polishing pad 140 to form the second polishing liquid 160*b*. In still a further embodiment, described below with reference to FIG. 5, the microfeature workpiece 150 can be moved from one polishing pad having the first polishing liquid 160*a* to a second polishing pad having the second polishing liquid 160*b*. In any of these embodiments, the doped silicon material 154 of the microfeature workpiece 150 is exposed to a polishing liquid having a surfactant with characteristics selected to remove and/or prevent the formation of the defects 156, as described in greater detail below.

In one embodiment, the surfactant is selected to be generally non-ionic. It is believed that a generally non-ionic surfactant can more readily adhere to an exposed surface 157 of the doped silicon material 154. Accordingly, the surfactant can passivate the exposed surface 157. This in turn can reduce the tendency for the polishing process to preferentially remove material from (a) grain boundaries of the doped silicon material 154 and/or (b) dopant-rich areas of the doped silicon material 154. In other embodiments, the generally non-ionic surfactant can reduce the number of defects 156 and/or the rate at which the defects 156 re-form via other mechanisms. In still further embodiments, the surfactant can have relatively low but non-zero ionicity while still performing these functions.

In a particular embodiment, the second polishing liquid 160*b* can simultaneously remove doped silicon material 154 from regions of having different crystalinities and/or different doping characteristics. Regions having different crystalinities include but are not limited to regions having different crystal orientations and/or different degrees of crystal order (e.g. different levels of amorphousness). Regions having different doping characteristics can include but are not limited to regions having different concentrations of dopants and/or different distributions of dopants. In any of these embodiments, the second polishing liquid 160*b* can simultaneously and uniformly remove selected quantities of the doped silicon material 154 from the microfeature workpiece 150 despite the differences in crystalinity and/or doping characteristics. For example, the second polishing liquid 160*b* can remove the portions of doped silicon material 154 from different regions of the microfeature workpiece 150 at at least approximately the same rate, despite variations in crystalinity and/or doping characteristics from one region to another.

In one embodiment, the surfactant of the second polishing liquid 160*b* can include polyoxyethylene ether. In a particular embodiment, the surfactant can have a chemical makeup identified by CAS No. 9004-95-9 (with CAS referring to the Chemical Abstracts Service, a division of the American Chemical Society). This surfactant is also identified by the trade name "Brij 58" (owned by ICI Americas of Wilmington, Del.). In a particular aspect of this embodiment, the second polishing liquid 160*b* can include Brij 58 surfactant at a concentration of about 0.001% to about 1.0% by weight. In further particular embodiments, the second polishing liquid 160*b* can include Brij 58 surfactant at a concentration of from about 0.1% to about 1.0%, or about 0.3% to about 1.0% by weight. In other embodiments, the surfactant can have other chemical compositions including, but not limited to, those identified in the article by Lee et al., previously incorporated herein by reference. In still further embodiments, the second polishing liquid 160*b* can include ionic surfactants at relatively low concentrations (e.g., less than 0.5% by weight), for example, in combination with one or more non-ionic surfactants.

One characteristic of the surfactant (in addition to reducing the likelihood for the formation and/or reformation of the defects 156) is that it can reduce the overall removal rate of the doped silicon material 154. Accordingly, it may be advantageous to limit the amount of the surfactant in the second polishing liquid 160*b*, for example, to a value of less than about 1.0% by weight. In other embodiments, for example, when the speed with which the doped silicon material 154 is removed is of less importance, the amount of surfactant in the second polishing liquid 160*b* can be increased.

In any of the foregoing embodiments, the second polishing liquid 160*b* can have an alkaline pH. For example, the second polishing liquid 160*b* can include an alkaline silica slurry having potassium hydroxide, sodium hydroxide, tetramethyl ammonium hydroxide, and/or piperazine. In other embodiments, the second polishing liquid 160*b* can include other constituents that provide the appropriate pH.

In one aspect of an embodiment described above with reference to FIGS. 2 and 3, at least a portion of the doped silicon material 154 is removed at a relatively high rate with the first polishing liquid 160*a*, in a process that may tend to form the defects 156. For example, this process can include a "bulk removal" process, conducted with a first polishing liquid 160*a* that does not include a surfactant, or includes a low enough concentration of surfactant so as not to significantly impede the material removal rate. The defects 156 are then removed at a slower rate as additional doped silicon material 154 is chemically-mechanically polished from the workpiece 150 by the second polishing liquid 160*b*. An advantage of this arrangement is that the combined or overall rate at which the doped silicon material 154 is removed can be at least moderately high because the initial portion of the doped silicon material 154 can be removed at a relatively high rate. In another embodiment, the initial "bulk removal" step can be eliminated, and the entire amount of doped silicon material 154 removed from the workpiece 150 can be removed with the second polishing liquid 160*b*. Such a method can be used, for example, when the total amount of doped silicon material 154 to be removed is relatively small, and/or when it is less critical that the doped silicon material 154 be removed quickly, and/or when it is undesirable to form any defects 156 (even those that can be subsequently removed) in the doped silicon material 154.

Figure 4:
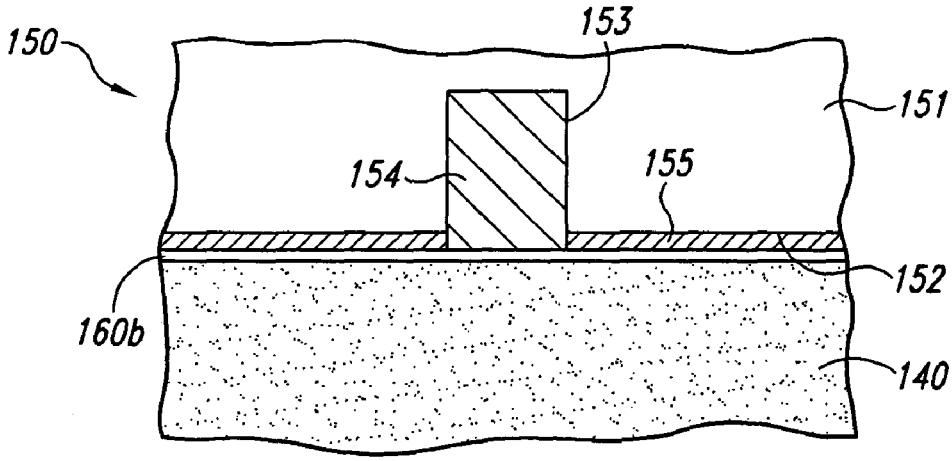
FIG. 4 is a partially schematic cross-sectional illustration of a microfeature workpiece after having a layer of doped silicon material removed.

Referring now to FIG. 4, the doped silicon material 154 can be removed to the level of the intermediate layer 155. In one embodiment, for example, when the intermediate layer 155 includes an antireflective coating, the material removal process can include removing the intermediate layer 155 to expose the substrate material surface 152. In another embodiment, the intermediate layer 155 can include a stop layer, and the material removal process can be halted upon exposing the intermediate layer 155. In still a further embodiment, as described above, the intermediate layer 155 can be eliminated, and the material removal process can continue through the doped silicon material 154 until the substrate material surface 152 is exposed.

In one aspect of certain embodiments described above with reference to FIGS. 2–4, the doped silicon material 154 is removed with one or two polishing liquids while remaining in contact with the same polishing pad material 140. In another embodiment, shown in FIG. 5, a first portion of the doped silicon material 154 can be removed at a first apparatus 510*a*, and a second portion of the doped silicon material 154 can be removed at a second apparatus 510*b*. Each apparatus 510*a*, 510*b* can include a platen 520 carrying a polishing pad material 540 and a carrier 530 configured to support the microfeature workpiece 150. In one embodiment, each apparatus 510*a*, 510*b* includes a polishing pad material 540 having the same composition. In another embodiment, the polishing pad material 540 of the first apparatus 510*a* can be different than the polishing pad material 540 of the second apparatus 510*b*. In either embodiment, suitable polishing pad materials 540 are available from vendors including Rodel of Newark, Del. In either embodiment, the first apparatus 510*a* can be configured to remove material from the microfeature workpiece 150 with the first polishing liquid 160*a*, and the second apparatus 510*b* can be configured to remove material from the microfeature workpiece 150 with the second polishing liquid 160*b*.

One feature of an embodiment of an arrangement described above with reference to FIG. 5 is that the first and second polishing liquids 160*a*, 160*b* can be kept separate from each other during processing. An advantage of this feature is that the chemical compositions of the polishing liquids can be maintained at controlled levels with relative ease. One feature of an embodiment of the arrangement described above with reference to FIGS. 2–4 is that the microfeature workpiece 150 need not be moved from one apparatus to another to remove the desired quantity of doped silicon material 154. An advantage of this feature is that the likelihood for damaging the microfeature workpiece 150 during handling can be reduced.

One feature of any of the embodiments described above with reference to FIGS. 2–5 is that a polishing liquid having one or more surfactants with the foregoing characteristics can effectively remove defect-containing doped silicon material while reducing or eliminating the formation of additional defects as additional doped silicon material is removed. An advantage of this feature, when compared to processes performed without such surfactants, is that the yield of microfeature workpieces 150 conforming to specifications can increase, which can in turn reduce the cost for forming microelectronic devices, including memory chips.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A method for removing material from a microfeature workpiece, comprising:

contacting a polishing pad material with a portion of a microfeature workpiece having a doped silicon material;

disposing a polishing liquid between the doped silicon material and the polishing pad material, the polishing liquid including a surfactant;

moving at least one of the microfeature workpiece and the polishing pad material relative to the other while the microfeature workpiece contacts the polishing pad material and the polishing liquid; and uniformly and simultaneously removing at least some of the doped silicon material from regions of the microfeature workpiece having different crystalinities and/or different doping characteristics by contacting the doped silicon material with the surfactant in the polishing liquid as at least one of the microfeature workpiece and the polishing pad material moves relative to the other.

2. The method of claim 1, further comprising inhibiting a chemical interaction between the doped silicon material and the polishing liquid by contacting the surfactant with the polishing liquid.

3. The method of claim 1, wherein uniformly and simultaneously removing at least some of the doped silicon material includes uniformly and simultaneously removing at least some of the doped silicon material from regions having different crystal orientations.

4. The method of claim 1, wherein uniformly and simultaneously removing at least some of the doped silicon material includes uniformly and simultaneously removing at least some of the doped silicon material from regions having different levels of amorphousness.

5. The method of claim 1, wherein uniformly and simultaneously removing at least some of the doped silicon material includes uniformly and simultaneously removing at least some of the doped silicon material from regions having different dopant concentrations.

6. The method of claim 1 wherein disposing a polishing liquid includes disposing a polishing liquid having a generally non-ionic surfactant, and wherein the method further comprises adhering the generally non-ionic surfactant to doped polysilicon.

7. The method of claim 1, further comprising controlling a temperature of an environment in which the polishing process takes place to be up to about 125 degrees Fahrenheit.

8. The method of claim 1 wherein moving at least one of the microfeature workpiece and the polishing pad material relative to the other while the microfeature workpiece contacts the polishing pad material and the polishing liquid includes reducing the formation of defects in the doped silicon material when compared with a polishing liquid that does not include the surfactant.

9. The method of claim 1, further comprising disposing the surfactant in the polishing liquid while the polishing liquid is in contact with the polishing pad material.

10. The method of claim 1 wherein removing at least some of the doped silicon material includes removing defects in the doped silicon material, and wherein the method further comprises forming the defects in the doped silicon material before uniformly removing at least some of the doped silicon material.

11. The method of claim 1 wherein removing at least some of the doped silicon material includes removing pit defects in the doped silicon material, and wherein the method further comprises forming the pit defects in the doped silicon material before uniformly removing at least some of the doped silicon material.

12. The method of claim 1 wherein removing at least some of the doped silicon material includes removing at least some of the doped silicon material from a filled recess.

13. The method of claim 1 wherein removing at least some of the doped silicon material includes removing polysilicon doped with phosphorous.

14. The method of claim 1 wherein disposing a polishing liquid includes disposing a polishing liquid that includes about 0.3% to about 1.0% surfactant by weight, the surfactant being generally non-ionic.

15. The method of claim 1 wherein disposing a polishing liquid includes disposing a polishing liquid that includes from about 0.001% to about 1.0% surfactant by weight, the surfactant being generally non-ionic.

16. The method of claim 1 wherein the microfeature workpiece has a surface with an aperture and wherein the doped silicon material is disposed in the aperture, further wherein the microfeature workpiece includes a layer of a material between the surface and the doped silicon material, and wherein the method further comprises removing the layer of material by contacting the layer of material with the polishing pad material and the polishing liquid.

17. The method of claim 1 wherein the microfeature workpiece has a surface with an aperture and wherein the doped silicon material is disposed in the aperture, and wherein the microfeature workpiece includes a stop layer between the surface and a portion of the doped silicon material external to the aperture, and wherein the method further comprises ceasing to remove material from the microfeature workpiece when the stop layer contacts the polishing pad material.

18. The method of claim 1 wherein disposing a polishing liquid includes disposing a polishing liquid having a surfactant with a non-zero ionicity.

19. The method of claim 1 wherein disposing a polishing liquid includes disposing a polishing liquid having a surfactant with a CAS registry number of 9004-95-9.

20. The method of claim 1 wherein disposing a polishing liquid includes disposing a polishing liquid having a polyoxyethylene ether surfactant.

21. The method of claim 1 wherein disposing a polishing liquid includes disposing an alkaline polishing liquid.

22. The method of claim 1 wherein disposing a polishing liquid includes disposing a polishing liquid that includes at least one of potassium hydroxide, sodium hydroxide, tetramethyl ammonium hydroxide and piperazine.

23. The method of claim 1, further comprising adhering the surfactant to the doped silicon material.

24. The method of claim 1 wherein removing at least some of the doped silicon material includes removing doped amorphous silicon.

25. The method of claim 1 wherein removing at least some of the doped silicon material includes removing doped polysilicon.

26. A method for removing material from a microfeature workpiece, comprising:

contacting a polishing pad material with a portion of a microfeature workpiece having a doped silicon material;

disposing a first polishing liquid between the doped silicon material and the polishing pad material;

moving at least one of the microfeature workpiece and the polishing pad material relative to the other while the microfeature workpiece contacts the polishing pad material and the first polishing liquid to remove at least a portion of the doped silicon material at a first rate;

disposing a second polishing liquid between the doped silicon material and the polishing pad material, the second polishing liquid having a surfactant;

uniformly and simultaneously removing at least some of the doped silicon material from regions of the microfeature workpiece having different polycrystaline crystalinities, and/or different doping characteristics, at a second rate slower than the first rate by contacting the doped silicon material with the surfactant in the second polishing liquid.

27. The method of claim 26, further comprising forming the second polishing liquid by disposing the surfactant in the first polishing liquid.

28. The method of claim 26, further comprising:

forming defects in the doped silicon material while moving at least one of the microfeature workpiece and the polishing pad material relative to the other with the microfeature workpiece contacting the polishing pad material and the first polishing liquid; and removing the defects in the doped silicon material by moving at least one of the microfeature workpiece and the polishing pad material relative to the other with the microfeature workpiece contacting the polishing pad material and the second polishing liquid.

29. The method of claim 26 wherein disposing a second polishing liquid includes disposing a second polishing liquid having a generally non-ionic surfactant, and wherein the method further comprises adhering the generally non-ionic surfactant to the doped silicon material.

30. The method of claim 26 wherein disposing a second polishing liquid includes disposing a second polishing liquid that includes from about 0.001% to about 1.0% surfactant by weight, the surfactant being generally non-ionic.

31. The method of claim 26 wherein the microfeature workpiece has a surface with an aperture and wherein the doped silicon material is disposed in the aperture, further wherein the microfeature workpiece includes a layer of a material between the surface and a portion of the doped silicon material external to the aperture, and wherein the method further comprises removing the layer of material by contacting the layer of material with the polishing pad material and the second polishing liquid.

32. The method of claim 26 wherein the microfeature workpiece has a surface with an aperture and wherein the doped silicon material is disposed in the aperture, and wherein the microfeature workpiece includes a stop layer between the surface and a portion of the doped silicon material external to the aperture, and wherein the method further comprises ceasing to remove material from the microfeature workpiece when the stop layer contacts the polishing pad material.

33. The method of claim 26 wherein disposing a second polishing liquid includes disposing a second polishing liquid having a surfactant with a CAS registry number of 9004-95-9.

34. The method of claim 26, further comprising inhibiting a chemical interaction between the doped silicon material and the second polishing liquid by contacting the surfactant with the second polishing liquid.

35. The method of claim 26 wherein uniformly and simultaneously removing at least some of the doped silicon material includes uniformly and simultaneously removing at least some of the doped silicon material from regions having different levels of amorphousness.

36. The method of claim 26 wherein uniformly and simultaneously removing at least some of the doped silicon material includes uniformly and simultaneously removing at least some of the doped polysilicon from regions having different dopant concentrations.

37. A method for removing material from a microfeature workpiece, comprising:

contacting a first polishing pad material with a portion of a microfeature workpiece having doped silicon material;

disposing a first polishing liquid between the doped silicon material and the first polishing pad material;

moving at least one of the microfeature workpiece and the first polishing pad material relative to the other while the microfeature workpiece contacts the first polishing pad material and the first polishing liquid to remove at least a portion of the doped polysilicon at a first rate;

contacting a second polishing pad material with the microfeature workpiece;

disposing a second polishing liquid between the doped silicon material and the second polishing pad material, the second polishing liquid having a surfactant; and simultaneously and uniformly removing at least some of the doped silicon material from regions of the microfeature workpiece having different crystalinities and/or different doping characteristics, at a second rate slower than the first rate by contacting the doped silicon material with the surfactant in the second polishing liquid.

38. The method of claim 37, further comprising moving the microfeature workpiece from a first apparatus having the first polishing pad material to a second apparatus having the second polishing pad material.

39. The method of claim 37, further comprising:

forming defects in the doped silicon material while moving at least one of the microfeature workpiece and the first polishing pad material relative to the other with the microfeature workpiece contacting the first polishing pad material and the first polishing liquid; and removing the defects in the doped silicon material by moving at least one of the microfeature workpiece and the second polishing pad material relative to the other with the microfeature workpiece contacting the second polishing pad material and the second polishing liquid.

40. The method of claim 37 wherein disposing a second polishing liquid includes disposing a second polishing liquid that includes from about 0.001% to about 1.0% surfactant by weight, the surfactant being generally non-ionic.

41. A method for removing material from a microfeature workpiece having a doped silicon material, comprising:

forming defects in the doped silicon material of the microfeature workpiece by disposing a first polishing liquid adjacent to the doped silicon material and removing a first portion of the doped silicon material by chemical-mechanical planarization, the first polishing liquid having a first composition; and disposing a second polishing liquid adjacent to the doped silicon material and removing a second portion of the doped silicon material and the defects by chemical-mechanical planarization, the second polishing liquid having a second composition different than the first composition.

42. The method of claim 41 wherein removing the first portion of the doped silicon material includes removing the first portion at a first rate and wherein removing the second portion of the doped silicon material includes removing the second portion at a second rate, the second rate being less than the first rate.

43. The method of claim 41, further comprising forming the second polishing liquid by disposing a surfactant in the first polishing liquid.

44. The method of claim 41 wherein disposing a second polishing liquid includes disposing a second polishing liquid that includes a surfactant.

45. The method of claim 41 wherein disposing a second polishing liquid includes disposing a second polishing liquid that includes from about 0.001% to about 1.0% surfactant by weight, the surfactant being generally non-ionic.

46. The method of claim 41 wherein removing the second portion of the doped silicon material includes uniformly removing the second portion of the doped silicon material from regions of the microfeature workpiece having different crystalinities and/or different doping characteristics.

47. The method of claim 41 wherein removing the second portion of the doped silicon material includes uniformly and simultaneously removing the second portion of the doped silicon material from regions having different levels of amorphousness.

48. The method of claim 41 wherein removing the second portion of the doped silicon material includes uniformly and simultaneously removing the second portion of the doped silicon material from regions having different dopant concentrations.

* * * * *

UNITED STATES PATENT AND TRADEMARK OFFICE

CERTIFICATE OF CORRECTION

PATENT NO. : 7,040,965 B2
APPLICATION NO. : 10/665964
DATED : May 9, 2006
INVENTOR(S) : Theodore M. Taylor It is certified that error appears in the above-identified patent and that said Letters Patent is hereby corrected as shown below:

Column 1
Line 34, "1" should be --I--;

Signed and Sealed this

Fifteenth Day of August, 2006

JON W. DUDAS
*Director of the United States Patent and Trademark Office*